US008029715B2

(12) United States Patent
Fogg et al.

(10) Patent No.: US 8,029,715 B2
(45) Date of Patent: Oct. 4, 2011

(54) ARTICLE OF FOOTWEAR WITH MESH ON OUTSOLE AND INSERT

(75) Inventors: Peter M. Fogg, Lake Oswego, OR (US); Paul Hooper, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/843,130

(22) Filed: Jul. 26, 2010

(65) Prior Publication Data

US 2010/0281630 A1 Nov. 11, 2010

Related U.S. Application Data

(63) Continuation of application No. 11/682,811, filed on Mar. 6, 2007, now Pat. No. 7,788,827.

(51) Int. Cl.
*B29C 45/14* (2006.01)
*A43C 15/02* (2006.01)

(52) U.S. Cl. .... 264/273; 36/59 C; 12/146 B; 12/142 RS

(58) Field of Classification Search ..... 12/142 RS, 12/142 S, 146 B, 146 T, 142 E; 36/59 C, 36/103, 11.5, 59 R, 44, 50.1, 50.5; 264/273, 264/257, 271.1
See application file for complete search history.

(56) References Cited

U.S. PATENT DOCUMENTS

| | | | |
|---|---|---|---|
| 12,219 | A | 1/1855 | Stevenson |
| 692,397 | A | 2/1902 | Wilkinson |
| 1,124,062 | A | 1/1915 | Robinson |
| 1,383,793 | A | 7/1921 | Eckel |
| 1,637,943 | A | 8/1927 | Jonas |
| 1,706,428 | A | 3/1929 | Ward |
| 1,706,478 | A | 3/1929 | Brogan |
| 1,811,803 | A | 6/1931 | Oakley |
| 2,127,634 | A | 8/1938 | Turner |
| 2,333,303 | A | 11/1943 | Enos |
| 2,349,975 | A | 5/1944 | Mackenzie |
| 2,364,134 | A | 12/1944 | Dow et al. |
| 2,391,564 | A | 12/1945 | Gregg |
| 2,400,487 | A | 5/1946 | Clark |
| 2,557,946 | A | 6/1951 | Crooker |
| 2,644,250 | A | 7/1953 | Ciaio |
| 3,190,016 | A | 6/1965 | Hansjosten |
| 3,555,697 | A | 1/1971 | Dassler |
| 3,888,026 | A | 6/1975 | Dassler |
| 4,245,406 | A | 1/1981 | Stirtz et al. |
| 4,297,796 | A | 11/1981 | Stirtz et al. |
| 4,407,034 | A | 10/1983 | Ralphs |
| 4,651,444 | A | 3/1987 | Ours |
| 4,876,053 | A | 10/1989 | Norton et al. |
| 4,899,465 | A | 2/1990 | Bleimhofer et al. |
| 4,970,807 | A | 11/1990 | Anderie et al. |
| 5,193,240 | A | 3/1993 | Salpietro |

(Continued)

FOREIGN PATENT DOCUMENTS

| | | |
|---|---|---|
| CA | 2042902 | 11/1991 |

(Continued)

*Primary Examiner* — Ted Kavanaugh
(74) *Attorney, Agent, or Firm* — Plumsea Law Group, LLC

(57) ABSTRACT

An article of footwear including a mesh disposed on the outsole and an insert of the outsole is disclosed. The outsole includes tread elements that extend farther from the outsole than the mesh, providing protection to the mesh. Additionally, the mesh on the insert preferably helps reduce hyperextension of the front of the insert and the article of footwear.

12 Claims, 8 Drawing Sheets

U.S. PATENT DOCUMENTS

| | | | | |
|---|---|---|---|---|
| 5,237,758 | A | 8/1993 | Zachman | |
| 5,285,583 | A | 2/1994 | Aleven | |
| 5,396,675 | A | 3/1995 | Vincent et al. | |
| 5,477,577 | A | 12/1995 | Hadley | |
| 5,561,919 | A | 10/1996 | Gill | |
| 5,628,127 | A | 5/1997 | Notzold | |
| 5,732,480 | A | 3/1998 | Notzold | |
| 5,791,068 | A | 8/1998 | Bernier et al. | |
| 5,918,338 | A | 7/1999 | Wong | |
| 5,935,671 | A | 8/1999 | Lhuillier | |
| 6,032,388 | A | 3/2000 | Fram | |
| 6,052,920 | A * | 4/2000 | Bathum | 36/11.5 |
| 6,231,946 | B1 | 5/2001 | Brown, Jr. et al. | |
| 6,285,583 | B1 | 9/2001 | Cleveland et al. | |
| 6,318,002 | B1 | 11/2001 | Ou | |
| 6,505,421 | B1 | 1/2003 | Vaz | |
| 6,557,274 | B2 | 5/2003 | Litchfield et al. | |
| 6,782,642 | B2 | 8/2004 | Knoche et al. | |
| 6,846,379 | B1 | 1/2005 | Bove et al. | |
| 7,036,246 | B2 | 5/2006 | Otis et al. | |
| 7,313,876 | B2 * | 1/2008 | Morgan et al. | 36/59 R |
| 7,367,141 | B2 | 5/2008 | Moretti | |
| 7,788,827 | B2 | 9/2010 | Fogg et al. | |
| 2001/0008053 | A1 | 7/2001 | Belli | |
| 2001/0045028 | A1 | 11/2001 | Crane et al. | |
| 2005/0241182 | A1 | 11/2005 | Otis et al. | |
| 2009/0211119 | A1 | 8/2009 | Moretti | |
| 2009/0277047 | A1 | 11/2009 | Moretti | |

FOREIGN PATENT DOCUMENTS

| | | |
|---|---|---|
| DE | 3738530 | 5/1989 |
| EP | 0111084 | 6/1984 |
| EP | 0353430 | 2/1990 |
| EP | 0389752 | 10/1990 |
| WO | WO 89/04125 | 5/1989 |
| WO | WO 94/13164 | 6/1994 |
| WO | WO 98/39984 | 9/1998 |

* cited by examiner

ARTICLE OF FOOTWEAR WITH MESH ON OUTSOLE AND INSERT

CROSS-REFERENCE TO RELATED APPLICATION

This application is a continuation of U.S. Pat. No. 7,788,827, currently U.S. application Ser. No. 11/682,811, entitled "Article of Footwear with Mesh on Outsole and Insert", filed on Mar. 6, 2007, and allowed on Jun. 29, 2010, which application is hereby incorporated by reference in its entirety.

BACKGROUND OF THE INVENTION

1. Field of the Invention

The present invention relates generally to footwear, and in particular an article of footwear with a mesh on the outsole and the insert.

2. Description of Related Art

Articles of footwear incorporating a mesh of some kind, especially on the outsole, have been previously proposed. In some cases, a mesh fabric or similar material may be placed on the bottom surface of an outsole in order to increase friction with the ground or other surfaces. Sometimes, a mesh fabric may be used to help reinforce the outsole.

Kuhtz et al. (EP patent number 1,177,884) teaches a shoe, in particular a running shoe, and a method for manufacturing the shoe. The Kuhtz design is intended to provide a running shoe with a sole having good damping properties and grip on the ground, as well as providing a low weight shoe. Kuhtz teaches a sole including a net-like structure that is embedded within the sole. The net-like structure may be made of polyester, polyamide, Kevlar, twaron, or other plastic materials. Kuhtz further teaches the knitting of various fibers of one or more different materials into a three-dimensional structure to achieve different profiles for the sole.

Stirtz et al. (U.S. Pat. No. 4,297,796) also teaches a shoe having a web-like structure. In the Stirtz design, the web-like material is an open mesh nylon web having elongated interwoven and inter-tied criss-crossing strands. The nylon web is diamond-shaped. Stirtz teaches the use of the nylon web to provide shock-absorption in shoes, and in particular in running shoes.

Stirtz, however, does not teach the use of a nylon web with the bottom of the outsole or the top of the insole. Instead, the nylon web is disposed between the outsole and a foot-receiving pad, within the sole construction. In other words, the Stirtz design does not incorporate a nylon web on the side of the outsole configured to contact the ground, or on the side of the insole configured to contact the foot.

Oakley (U.S. Pat. No. 1,811,803) teaches a rubber sole and heel for boots and shoes. In the Oakley design, a textile fabric is incorporated into the sole and heel of a shoe. This arrangement is intended to increase the anti-slip properties of the shoe. Oakley further teaches using the textile fabric with soles and heels to increase the wear resistant qualities of the shoe.

Otis et al., (U.S. Pat. No. 7,036,246) teaches a shoe with a slip-resistant and shape-retaining fabric outsole. In particular, Otis teaches a house slipper that comprises a fabric material and a backing layer of shape-retaining, moldable material. In the Otis design, the fabric layer and the backing layer are molded integrally together. Examples fabric layers taught by Otis include thin, flexible, fabric material, such as knitted or woven cloth.

While the prior art teaches articles of footwear with integrated fabrics or mesh, there are several shortcomings. The prior art does not teach soles with tread elements that project beyond the surface of the sole. Such tread elements may extend through the fabric or mesh material, and limit the time the fabric or mesh material is in direct contact with the ground. By doing this, the fabric or mesh may experience less wear. Furthermore, the prior art does not teach the application of a fabric or mesh to an insole. Also, the prior art does not teach the use of a mesh on the outer periphery of the sole. There is a need in the art for an article of footwear that addresses these shortcomings of the prior art.

SUMMARY OF THE INVENTION

An article of footwear including a mesh disposed on an outsole and an insert is disclosed. In one aspect, the invention provides an article of footwear, comprising: an outsole including a top surface and a bottom surface; a mesh attached to the bottom surface, wherein a portion of the mesh is exposed; at least one tread element disposed on the bottom surface; the tread element including a tread body and a tread surface; wherein a portion of the tread body is attached to the bottom surface of the outsole; and where the tread surface is spaced from the exposed mesh and the bottom surface thereby protecting the mesh from contact with the ground surface.

In another aspect, the distance between the tread surface and the top surface of the outsole is greater than the distance between the mesh and the top surface of the outsole.

In another aspect, the article of footwear is configured to contact a ground surface and wherein the tread element protects the mesh from contact with the ground surface.

In another aspect, the outsole includes an outer periphery and an outer side surface.

In another aspect, a portion of the mesh is disposed on the outer side surface.

In another aspect, the outsole is associated with an insert.

In another aspect, the invention provides an article of footwear, comprising: an outsole including an upper surface, a bottom surface and an outer periphery, where the upper surface is disposed closer to a wearer's foot than the bottom surface, and where the bottom surface and the outer periphery are exposed; and where the outer periphery includes an outer side surface, and wherein a mesh is disposed on the outer side surface of the outer periphery.

In another aspect, the outsole is associated with an insert.

In another aspect, a mesh is disposed on the insert.

In another aspect, the outsole is associated with a strap system.

In another aspect, the strap system comprises four straps.

In another aspect, the outsole includes a toe member.

In another aspect, the outsole includes a heel member.

In another aspect, the invention provides an article of footwear, comprising: an insert including an outer surface configured to contact a wearer's foot; the insert configured to be received by an outsole, and wherein the insert is associated with the outsole; and where a mesh is disposed on the outer surface of the insert.

In another aspect, the mesh is embedded in the outer surface of the insert.

In another aspect, the outsole includes a bottom surface.

In another aspect, a mesh is disposed on the bottom surface.

In another aspect, the mesh reduces hyperextension of the insert.

In another aspect, the outsole is associated with a strap system.

In another aspect, the strap system includes a first strap fastener and a second strap fastener.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
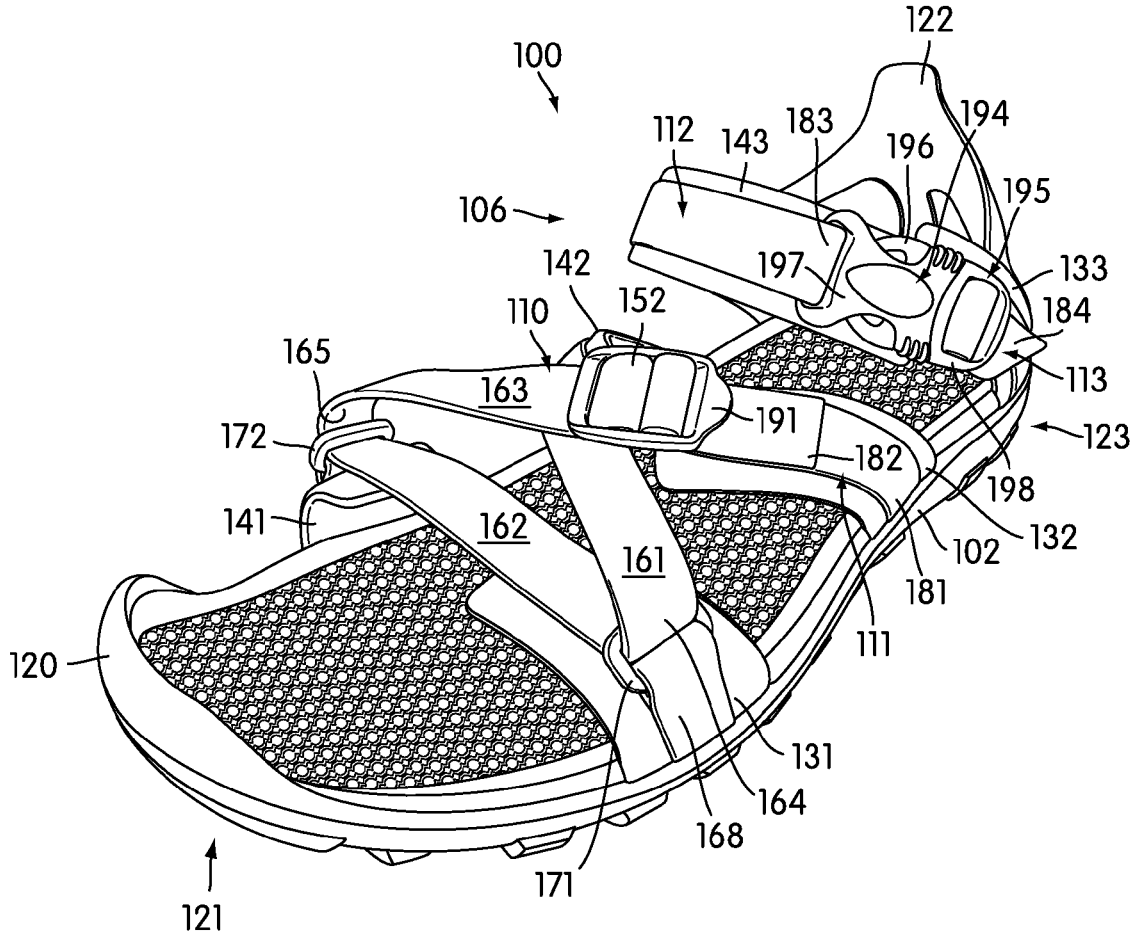
FIG. 1 is an isometric view of a preferred embodiment of an article of footwear.

FIG. 1 is a preferred embodiment of an article of footwear 100 in the form of a sandal. For clarity, the following detailed description discusses a preferred embodiment, however this description may also be applied to various other types of footwear. Examples of such footwear include, but are not limited to, athletic shoes, water shoes, cycling shoes, dance shoes, slippers, or any other kind of footwear.

Article of footwear 100 includes sole 102. In some embodiments, sole 102 may be made from any suitable material, including but not limited to elastomers, siloxanes, natural rubber, other synthetic rubbers, aluminum, steel, natural leather, synthetic leather, plastics, as well as other materials. In a preferred embodiment, sole 102 may be made from a type of rubber.

In this embodiment, sole 102 may be integrally formed with toe member 120 and heel member 122. Preferably, toe member 120 is an extension of sole 102 that projects from toe portion 121 of sole 102. Likewise, heel member 122 is preferably an extension of sole 102 that projects from heel portion 123 of sole 102. Using this arrangement, toe member 120 and heel member 122 preferably provide protection for the toes and heel, respectively. In particular, toe member 120 preferably prevents injuries such as a stubbed toe, which is a common injury associated with sandals. Additionally, heel member 122 may prevent injuries, such as scratches or bruising, to a wearer's heel.

Preferably, article of footwear 100 includes provisions for securing sole 102 to a wearer's foot. In some embodiments, such provisions could take the form of a shoe upper. In some embodiments, sole 102 may be secured to a wearer's foot using one or multiple straps. In this preferred embodiment, sole 102 may be secured to a wearer's foot using strap system 106.

Figure 2:
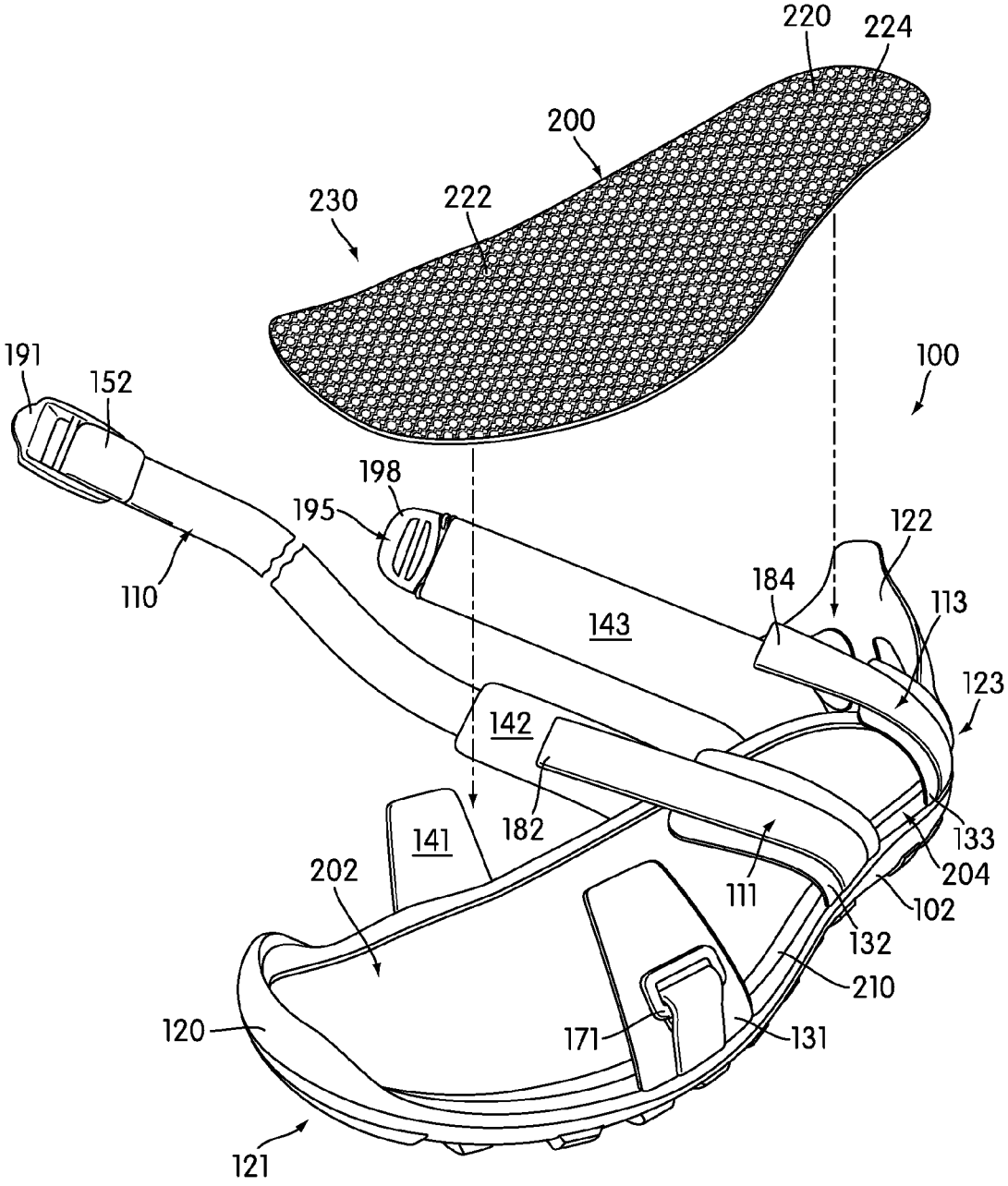
FIG. 2 is an exploded isometric view of a preferred embodiment of an article of footwear.
Figure 3:
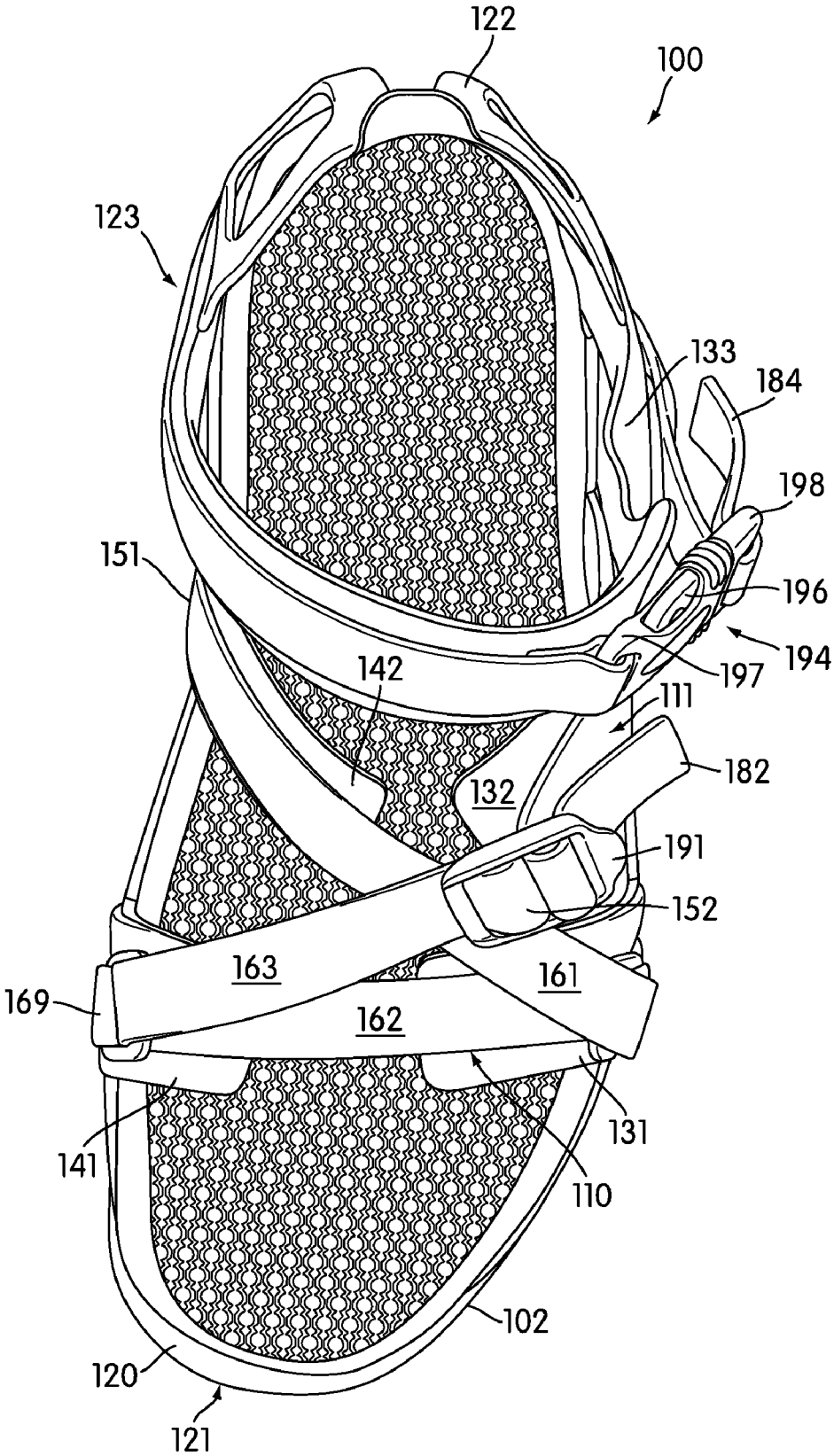
FIG. 3 is a top down view of a preferred embodiment of an article of footwear.

Referring to FIGS. 1-3, strap system 106 preferably comprises first strap 110, second strap 111, third strap 112 and fourth strap 113. Straps 110-113 may be made from any materials suitable for use as straps configured to contact a wearer's foot. Examples of such materials include, but are not limited to, nylon, natural leather, synthetic leather, natural rubber, synthetic rubber or other kinds of flexible materials. In a preferred embodiment, first strap 110, second strap 111, third strap 112 and fourth strap 113 may preferably be made of synthetic leather or similar materials, such as natural leather.

In some embodiments, strap system 106 may further comprise first lateral strap pad 131, second lateral strap pad 132 and third lateral strap pad 133. Additionally, in some embodiments, strap system 106 may comprise first medial strap pad 141, second medial strap pad 142 and third medial strap pad 143. Lateral strap pads 131-133 and medial strap pads 141-143 may be constructed from any material, including any of the materials discussed in association with straps 110-113. Preferably, lateral strap pads 131-133 and medial strap pads 141-143 may be used in order to reduce friction that may occur between a wearer's foot and straps 110-113. For this reason, lateral strap pads 131-133 and medial strap pads 141-143 may be made of a material with a comfortable feel, in order to reduce friction with a wearer's foot.

In this preferred embodiment, first portion 161 of first strap 110 may be disposed between second medial strap pad 142 and first lateral strap pad 131. Second portion 162 of first strap 110 may be disposed between first lateral strap pad 131 and first medial strap pad 141. Third portion 163 of first strap 110 may be disposed between first medial strap pad 141 and second lateral strap pad 132. Preferably, this arrangement of first strap 110 is such that first intermediate portion 164 of first strap 110 is disposed through first loop 171 and second intermediate portion 165 of first strap 110 is disposed through second loop 172. In this preferred embodiment, first loop 171 and second loop 172 are attached to sole 102 via first short strap 168 and second short strap 169. Furthermore, first end 151 of first strap 110 may be attached at heel portion 123 of sole 102 (see FIG. 3).

In some embodiments, second strap 111 may be disposed on second lateral strap pad 132. Preferably, first end 181 of second strap 111 may be attached to sole 102 at heel portion 123. Second end 182 of second strap 111 is preferably associated with second end 152 of first strap 110 via first strap fastener 191. First strap fastener 191 may be any device that allows first strap 110 and second strap 111 to be adjustably fastened together.

Preferably, third strap 112 and fourth strap 113 may be associated with a wearer's ankle. In this embodiment, third medial strap pad 143 may be configured to extend across the front of a wearer's ankle. Third strap 112 may preferably be disposed on third medial strap pad 143, and in some embodiments, third strap 112 may be attached to medial strap pad 143 on the entire length of third medial strap pad 143. Additionally, fourth strap 113 may be disposed on third lateral strap pad 133 and, in some embodiments, fourth strap 113 may be attached to third lateral strap pad 133.

Preferably, article of footwear 100 includes provisions for tightening and easily fastening third strap 112 around a wearer's ankle. In this embodiment, first end 183 of third strap 112 may be associated with first end 184 of fourth strap 113. In particular, first end 183 of third strap 112 may be joined to first end 184 of fourth strap 113 via second strap fastener 194. In a preferred embodiment, second strap fastener 194 includes tightening slots 195 and releasable tabs 196. Generally, fourth strap 113 may be disposed through tightening slots 195 and adjusted in a manner that applies tension to third strap 112 and secures third strap 113 around a wearer's ankle. For quick release a wearer may pinch releasable tabs 196, which allows first portion 197 of second strap fastener 194 to separate from second portion 198. Using this configuration, a wearer may adjustably tighten third strap 112 around the ankle and also quickly undo or re-fasten third strap 112 in place using releasable tabs 196.

Generally, this strap arrangement allows sole 102 to be secured to a wearer's foot at the instep of the foot, using first strap 110 and second strap 111. Furthermore, sole 102 may be secured to a wearer's foot at the ankle using third strap 112 and fourth strap 113. Because third strap 112 may be releasably fastened to fourth strap 113, a wearer may easily slip article of footwear 100 on and off of their foot, increasing the ease of use of article of footwear 100.

Preferably, article of footwear 100 includes provisions for securing a user's foot to sole 102. In some embodiments, article of footwear 100 may be associated with a midsole and/or an insole. In a preferred embodiment, article of footwear 100 may include an insert that may function in a similar manner to an insole.

Referring to FIG. 2, sole 102 may be associated with insert 200. In some embodiments, insert 200 may be configured to fit within recess 202 of sole 102. In this embodiment, the boundaries of recess 202 are formed by peripheral rim 204. Preferably, the height of peripheral rim 204 is approximately equal to the thickness of insert 200, so that outer surface 222 of insert 200 may be coincident with upper surface 210 of peripheral rim 204.

Preferably, insert 200 may include provisions for increasing traction with a wearer's foot. In some embodiments, a fabric liner or a fabric-like material may be associated with insert 200. In a preferred embodiment, a mesh may be applied to the outer surface of insert 200.

The term mesh, as used throughout this detailed description, preferably refers to any woven material. Generally, a mesh may comprise fiber-like strands that are woven together. Typically, a mesh includes holes that are visible and integrated into the design of the mesh. Examples of materials used to construct a mesh include, but are not limited to, natural fibers, polyester, polyamide, nylon, as well as other natural or synthetic materials.

Insert 200 preferably includes first mesh 220, disposed on outer surface 222 of insert 200. Preferably, first mesh 220 includes first mesh holes 224. In some embodiments, the diameter of holes 224 may be large with respect to the width of the fibers comprising first mesh 220. In a preferred embodiment, first mesh 220 may be made of a textile or similar material.

In some embodiments, first mesh 220 may be disposed on the entire outer surface 222 of insert 200. In other embodiments, first mesh 220 may be disposed on a portion, or multiple portions, of insert 200. In a preferred embodiment, first mesh 220 may be embedded within insert 200. In other words, portions of insert 200 may be extended into first mesh 220 such that outer surface 222 of insert 200 is coincident with first mesh 220. In other embodiments, outer surface 222 may envelop a portion of first mesh 220, so that a lower portion of first mesh 220 is molded to, or otherwise attached to outer surface 222, while an upper portion of first mesh 220 is exposed. This arrangement preferably forms a flat surface on upper side 230 of insert 200, allowing for smooth contact surface that receives a wearer's foot. In some embodiments, first mesh 220 may be embedded in insert 200 during a molding process.

As first side 230 of insert 200 is preferably configured to receive a wearer's foot, first mesh 220 may be disposed against a wearer's foot while article of footwear 100 is being worn. This preferred mesh arrangement preferably provides additional traction between the wearer's foot and sole 102.

In addition to increasing the frictional properties of outer surface 222 of insert 200, first mesh 220 may also provide additional structural support to insert 200 and article of footwear 100. In particular, the use of first mesh 220 preferably helps to reinforce insert 200. With this configuration, it may be more difficult to weaken or break insert 200. This feature preferably increases the durability and, in some cases, the lifetime of insert 200.

Preferably, sole 102 may also include provisions that improve traction and supply additional structural support. In some embodiments, sole 102 may also include a mesh. In a preferred embodiment, the entire bottom surface of sole 102 may be covered with a mesh of some kind. Additionally, the mesh may be disposed on the outer periphery of the outsole.

Figure 4:
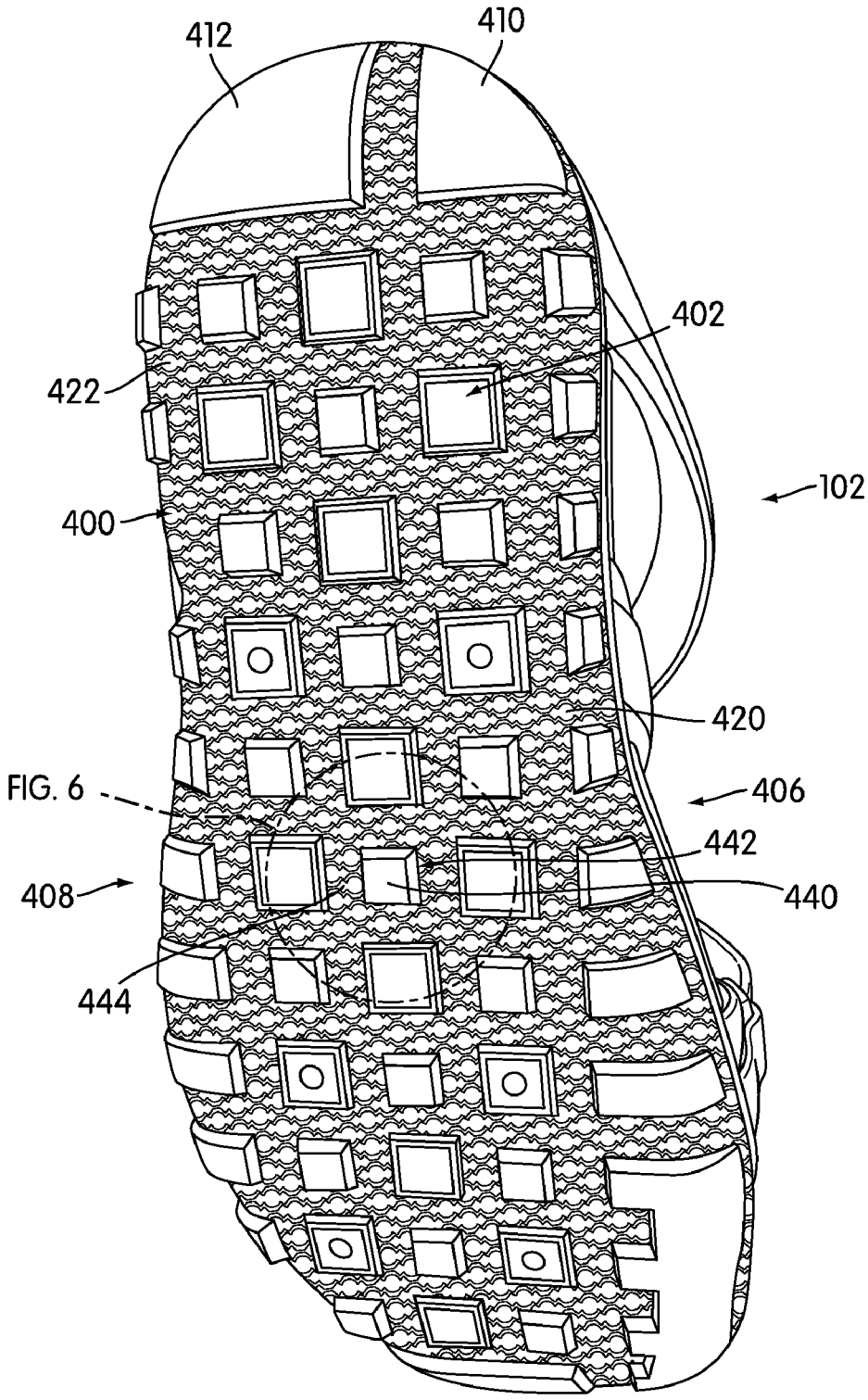
FIG. 4 is a bottom view of a preferred embodiment of an article of footwear.
Figure 5:
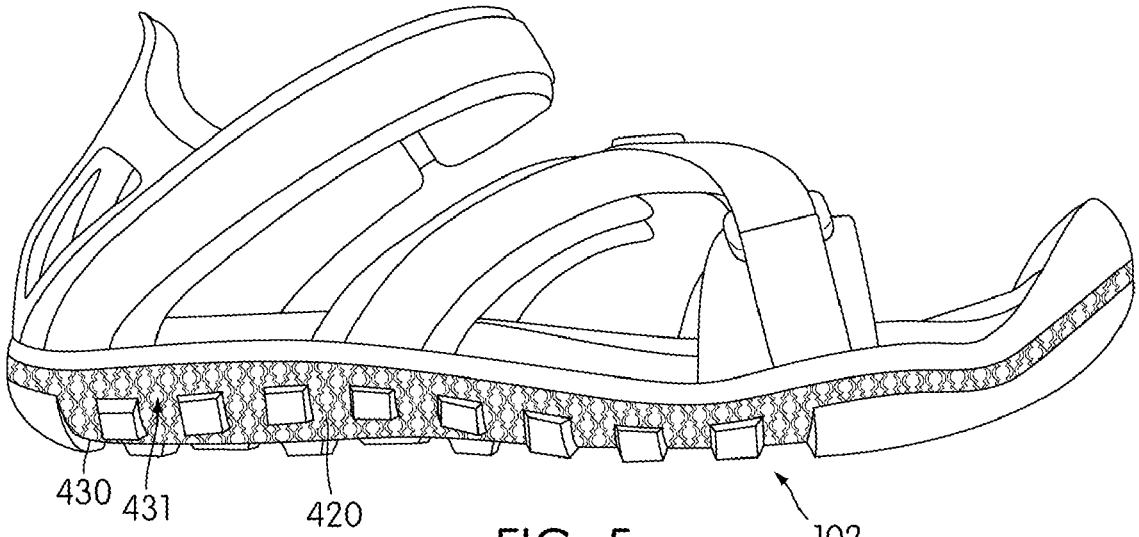
FIG. 5 is a side view of a preferred embodiment of an article of footwear.
Figure 6:
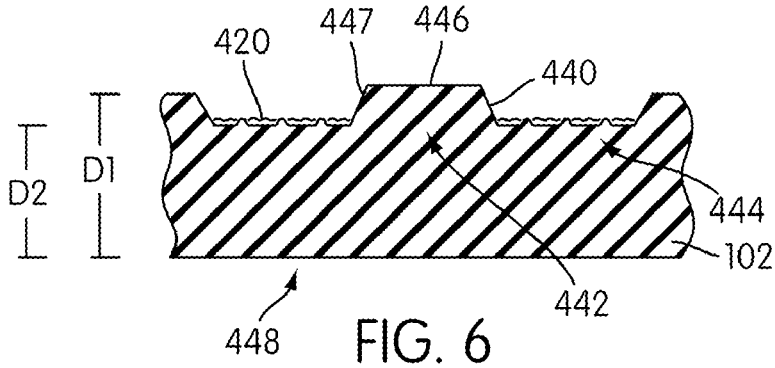
FIG. 6 is a schematic cross section of a preferred embodiment of an outsole.

Referring to FIGS. 4-6, bottom side 400 of sole 102 preferably includes tread system 402. Tread system 402 generally have a square-like geometry. In this embodiment, tread system 402 comprise two distinct types sizes of tread elements, which alternate along vertical and horizontal rows. Additionally, tread system 402 include irregular and rectangular tread elements disposed on medial side 406 and lateral side 408 of sole 102. In a preferred embodiment, tread system 402 include first rear tread 410 and second rear tread 412 that have triangular-like geometries and are generally larger than the remaining tread elements. This preferred tread arrangement may provide increased traction over a flat outsole bottom.

In some embodiments, bottom side 400 also includes second mesh 420. Preferably, second mesh 420 may be disposed on bottom surface 422 of bottom side 400. In particular, second mesh 420 is preferably disposed on sole 102, and exposed between tread system 402. Like first mesh 220 that is disposed on insert 200, portions of second mesh 420 are preferably embedded within sole 102. In a preferred embodiment, second mesh 420 may be combined with bottom surface 422 during the molding of sole 102, so that portions of second mesh 420 may be coincident with bottom surface 422 of sole 102.

Additionally, as seen in FIG. 5, second mesh 420 may be disposed on outer periphery 430 of sole 102. In this embodiment, outer periphery 430 includes outer side surface 431, which is preferably disposed at an angle from bottom surface 422 (shown in FIG. 4) of sole 102. In some embodiments, outer side surface 431 of outer periphery 430 may curve outwards and up from bottom surface 422. Preferably, second mesh 420 is disposed on the entire outer side surface 431 of outer periphery 430, however, in other embodiments, second mesh 420 may be disposed on just one or multiple portions of outer periphery 430. Only one example of outer side surface 431 of outer periphery 430 is shown in FIG. 5, however second mesh 420 may be also be disposed on portions of outer periphery 430 that extend to toe portion 121, heel portion 123 and lateral side 408 of sole 102.

In some embodiments, tread system 402 may project through regions of second mesh 420, as seen in FIG. 4 and FIG. 6 (a cross sectional view of a single tread element). These regions may be holes or cut-outs that tread system 402 may project through, from bottom side 400. In this embodiment, tread element 440 is disposed on first region 442 of sole 102. Second mesh 420 is disposed on second region 444 of sole 102, where second region 444 preferably surrounds first region 442. Tread element 440 also includes tread surface 446 and is attached to sole 102 on tread body 447. Preferably, tread surface 446 extends a first distance D1 from upper side 448 of sole 102. Likewise, second mesh 420 is preferably extended a second distance D2 from upper side 448 of sole 102. It is clear that first distance D1 is greater than second distance D2. Preferably, each of the tread elements comprising tread system 402 has this arrangement between tread element 440 and second mesh 420. In other words, each of the treads comprising tread system 402 preferably project through and below second mesh 420. This configuration allows tread system 402 to provide primary contact of sole 102 with the ground or other surfaces. By using this arrangement, second mesh 420 may not wear as much as it would if it were in direct contact with the ground.

The application of second mesh 420 to sole 102, on bottom surface 422 and outer periphery 430, may increase the durability and service life of sole 102. In particular, the use of second mesh 420 preferably helps to reinforce sole 102, decreasing the tendency of sole 102 to weaken or break.

Generally, second mesh 420 may be made from any of the materials discussed with respect to the construction of first mesh 220. It should be understood that first mesh 220 and second mesh 420 are preferably distinct meshes that are preferably not continuously joined. While some embodiments may incorporate the use of a single mesh, the two distinct meshes 220 and 420 described here are clearly separate, as seen in the figures. In a preferred embodiment, first mesh 220 and second mesh 420 have no region of overlap, due to their separation by peripheral rim 204 of sole 102.

Figure 7:
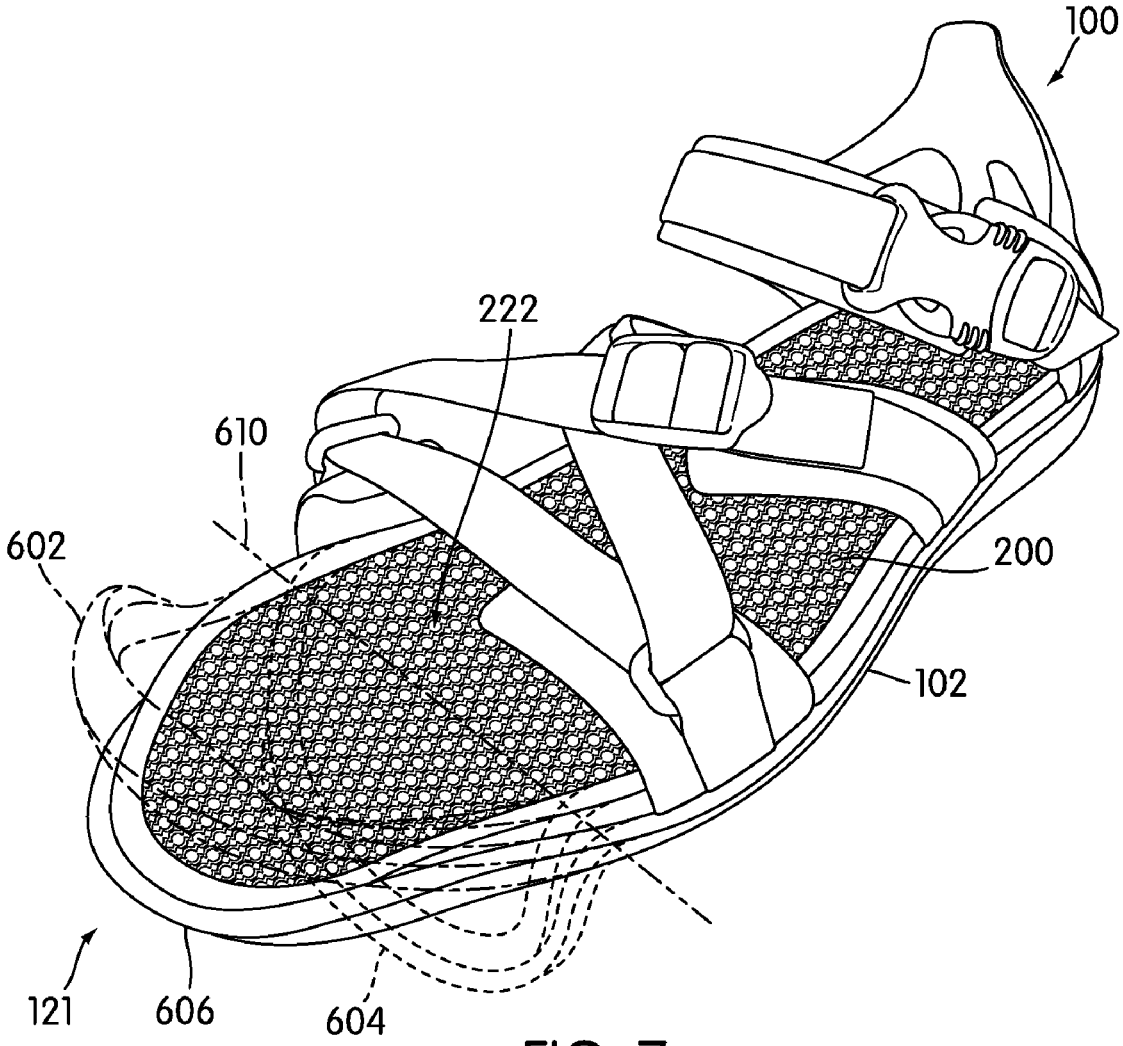
FIG. 7 is an isometric view of a preferred embodiment of an article of footwear.
Figure 8:
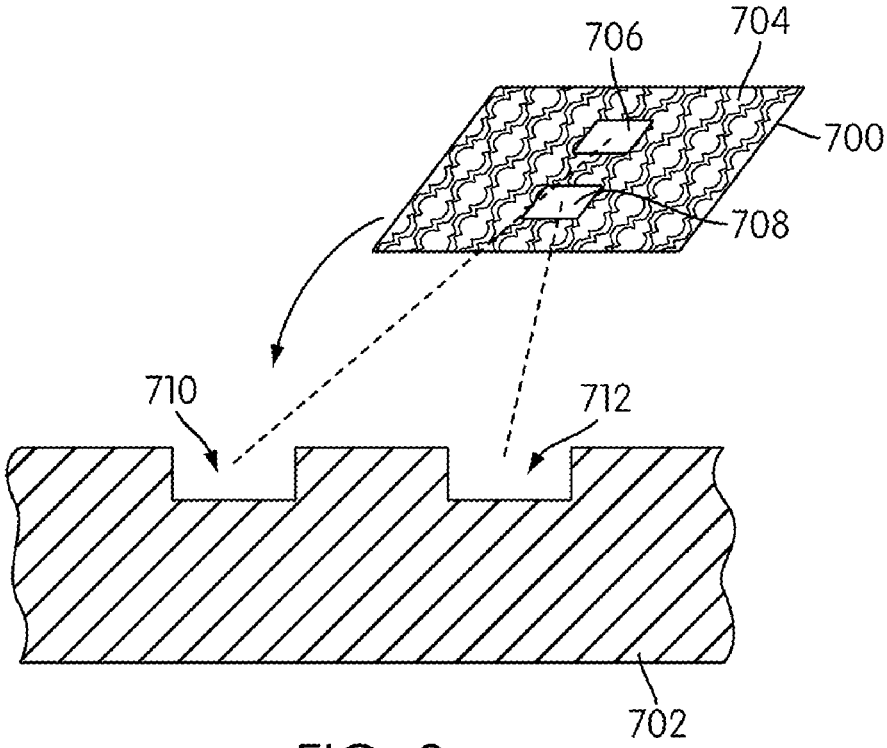
FIG. 8 is a schematic cross section of a preferred embodiment of a mold.
Figure 9:
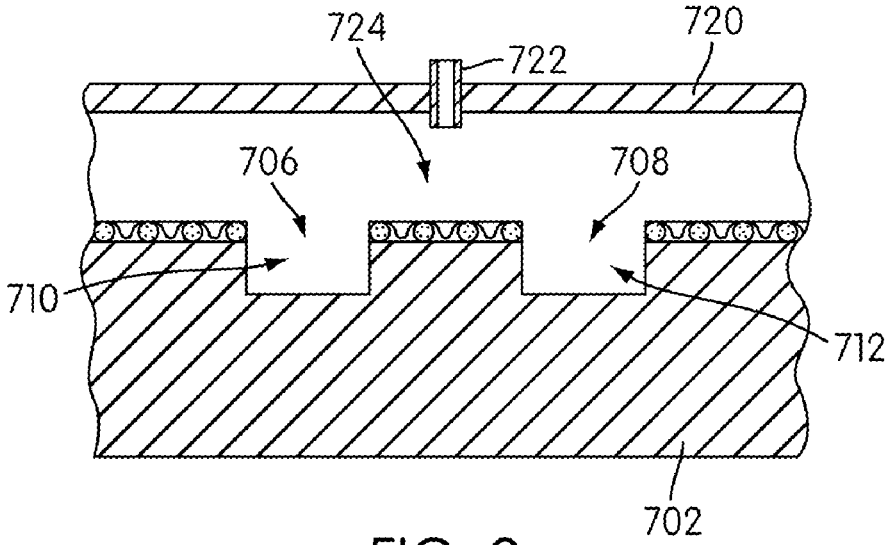
FIG. 9 is a schematic cross section of a preferred embodiment of a mold.

Some embodiments include provisions to help prevent hyperextension of toe portion 121. Referring to FIG. 7, toe portion 121 may be in first position 602 (shown in phantom) under normal circumstances. In some cases, article of footwear 100 may undergo a force that would tend to hyperextend toe portion 121. Such a case may occur when any part of sole 102 adjacent to toe portion 121 is caught against an extended object. Typically such an event occurs when hiking, as the front of an outsole may catch against a rock or stick. Without provisions to prevent hyperextension of the front of sole 102, article of footwear 100 may undergo bending at axis 610. In this case, toe portion 121, including the front portions of sole 102 and insert 200, may be in second position 604 (also shown in phantom). Generally, this amount of bending could lead to injury of the wearer's foot, and in particular to the toes.

In a preferred embodiment, as toe portion 121 undergoes bending, first mesh 220 helps to restrain the motion and bending of toe portion 121. Specifically, first mesh 220 provides a restraining force to outer surface 222 of insert 200. This restraining force preferably acts in a manner to prevent insert 200 from undergoing a substantial amount of bending, as first mesh 220 is preferably constructed of a material that is substantially non-elastic. In a similar manner, as toe portion 121 undergoes bending, second mesh 420 may provide a tension force throughout bottom surface 422 of sole 102. This tension force preferably acts in a manner to prevent sole 102 from undergoing a substantial amount of bending, as second mesh 420 is preferably constructed of a material that is substantially non-elastic. Preferably, as insert 200 is disposed against sole 102, article of footwear 100 is prevented from substantially hyperextending at toe portion 121. Instead, toe portion 121 may be disposed in third position 606. This reduction in the amount of bending (compare second position 604 with third position 606) preferably reduces the chance of injury to the wearer of article of footwear 100.

It should be understood that first mesh 220 and second mesh 420 may also provide article of footwear 100 with unique aesthetic characteristics. In some cases, first mesh 220 and second mesh 420 may provide a sense of detail that is not usually found in molded rubber outsoles or molded inserts. In other words, first mesh 220 and second mesh 420 may provide article of footwear 100 with unique decorative patterns.

The following steps describe a general method for preparing an outsole with a mesh disposed on the bottom side. Although the following detailed description discusses a preparation method for an outsole, it should be understood that a similar method may be applied to forming an insert with a mesh disposed on an outer surface of the insert. Furthermore, the figures discussed in the following section are only schematic illustrations of the process, and for clarity only show a section of the mold used to manufacture an outsole. In general, molds used for forming outsoles may be any size and include any number of tread cavities, as well as other features.

Referring to FIGS. 8-11, a method for forming a sole with a mesh includes a first step of associating mesh 700 with molding base 702. Mesh 700 may be constructed in a manner similar to first mesh 220 and second mesh 420, discussed with respect to the previous embodiment. In particular, mesh 700 may be formed from any of the various materials previously discussed. Preferably, mesh 700 may include mesh holes 704 as well as first tread hole 706 and second tread hole 708. First tread hole 706 is preferably associated with first tread cavity 710 of molding base 702. Likewise, second tread hole 708 is preferably associated with second tread cavity 712 of molding base 702.

During a second step, mesh 700 may be disposed across molding base 702 such that first tread hole 706 and second tread hole 708 aligned with first tread cavity 710 and second tread cavity 712. Additionally, during this second step, molding top 720 may be placed over molding base 702. Preferably, molding top 720 includes injection port 722 that may be used to inject a molding material into central cavity 724. It should be understood that there is no need to fix mesh 700 to molding base 702 during this step.

During a third step, molding material 730 may be injected into central cavity 724. In some embodiments, molding material 730 may be any of the materials discussed as materials that may be used to construct the outsole discussed in the previous embodiments as long as the material may be molded. In this embodiment, molding material 730 is a liquefied rubber material that is injected through injection portion 722. Preferably molding material 730 fills not only tread cavities 710 and 712, but mesh holes 704 as well.

Figure 10:
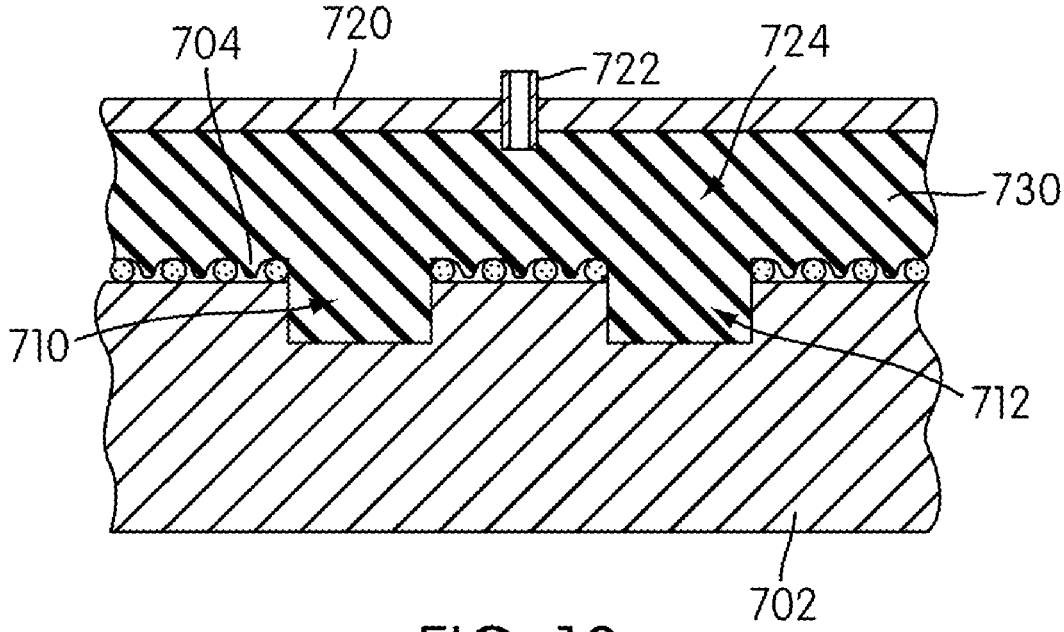
FIG. 10 is a schematic cross section of a preferred embodiment of a mold.
Figure 11:
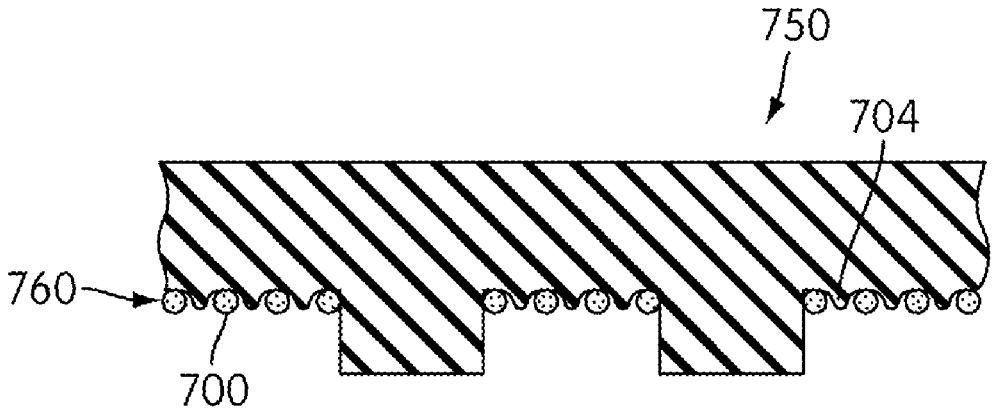
FIG. 11 is a schematic cross section of a preferred embodiment of a molded outsole.

Finally, during a fourth and final step, molding base 702 and molding top 720 may be removed, yielding molded outsole 750. As seen in FIG. 10, mesh material 700 has been integrated with bottom surface 760 of molded outsole 750.

It will be understood that known compression molding techniques may be used as an alternative to injection molding. In using compression molding, a mold is provided and a sheet of mesh material and sole material are laid into the mold. A mold cover is positioned on the mold, then the mold and materials are subjected to pressure and applied heat until the materials are deformed to the shape of the mold.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method for producing an outsole with an attached mesh for an article of footwear, comprising the steps of:

disposing a mesh across a molding base, the mesh including at least one tread hole corresponding in size to at least one tread cavity disposed in the molding base;

aligning the at least one tread hole in the mesh with the at least one tread cavity disposed in the molding base;

placing a molding top including an injection port over the molding base associated with the mesh;

injecting a molding material into a central cavity formed between the molding top and the molding base through the injection port, wherein the molding material fills the central cavity and the tread cavity; and removing the molding base and the molding top to yield the outsole with the attached mesh, wherein the mesh is attached to a bottom surface of the outsole and at least a portion of the mesh is exposed.

2. The method according to claim 1, wherein the at least one tread cavity is configured to produce at least one tread element with a tread surface that is spaced from the exposed mesh and the bottom surface thereby protecting the mesh from contact with a ground surface.

3. The method according to claim 1, wherein the outsole further includes an outer periphery and an outer side surface.

4. The method according to claim 3, wherein a portion of the mesh is disposed on the outer side surface.

5. The method according to claim 1, wherein the at least one tread cavity is configured to produce at least one tread element that projects through the at least one tread hole in the mesh.

6. The method according to claim 1, wherein the molding material is a liquefied rubber material.

7. The method according to claim 1, wherein the mesh further includes a plurality of mesh holes; and wherein the step of injecting the molding material further includes filling a portion of the plurality of mesh holes with the molding material.

8. A method for manufacturing an outsole having an attached mesh for an article of footwear, comprising the steps of:

providing a mold including a molding base and a molding top, the molding base and the molding top corresponding to a shape of the outsole;

disposing a mesh across the molding base, the mesh including at least one tread hole corresponding in size to at least one tread cavity disposed in the molding base, the at least one tread cavity configured to produce at least one tread element;

aligning the at least one tread hole in the mesh with the at least one tread cavity disposed in the molding base;

providing molding material into the mold, the molding material forming the outsole and the at least one tread element;

removing the mold to yield the outsole with the attached mesh, wherein the mesh is attached to a bottom surface of the outsole and at least a portion of the mesh is exposed; and wherein the at least one tread element projects through the at least one tread hole in the mesh.

9. The method according to claim 8, wherein the step of providing the molding material into the mold further includes:

injection molding the molding material into a central cavity formed between the molding top and the molding base; and wherein the molding material fills the central cavity and the at least one tread cavity.

10. The method according to claim 9, wherein the at least one tread cavity is configured to produce the at least one tread element having a tread surface that is spaced from the exposed mesh and the bottom surface thereby protecting the mesh from contact with a ground surface.

11. The method according to claim 8, wherein the mesh further includes a plurality of mesh holes; and wherein the step of providing the molding material into the mold further includes filling a portion of the plurality of mesh holes with the molding material.

12. The method according to claim 8, wherein the outsole is further adapted to be associated with a strap system to form the article of footwear.

* * * * *